United States Patent [19]

Kulhanek et al.

[11] 4,372,379

[45] Feb. 8, 1983

[54] ROTARY DRIVE ASSEMBLY FOR DOWNHOLE ROTARY PUMP

[75] Inventors: Emanuel Kulhanek; John Aboussafy, both of Edmonton, Canada

[73] Assignee: Corod Manufacturing Ltd., Nisku, Canada

[21] Appl. No.: 309,004

[22] Filed: Oct. 6, 1981

[51] Int. Cl.[3] ..... E21B 43/00

[52] U.S. Cl. ..... 166/68.5; 166/78; 166/88

[58] Field of Search ..... 166/68.5, 78, 88; 417/362, 424; 92/137; 175/195, 202

[56] References Cited

U.S. PATENT DOCUMENTS

| | | | |
|---|---|---|---|
| 2,471,198 | 5/1949 | Cormany | 166/78 |
| 3,891,031 | 6/1975 | Ortiz | 166/68.5 |
| 4,087,211 | 5/1978 | Pochyly | 417/424 |
| 4,089,624 | 5/1978 | Nichols et al. | 417/362 |
| 4,314,611 | 2/1982 | Willis | 173/57 |

OTHER PUBLICATIONS

*Composite Catalog of Oil Field Equipment & Services,* published by World Oil, Gulf Publishing Co., Houston, Texas, 25th Rev., 1962–1963, vol. 3, p. 5366.

*Primary Examiner*—Stephen J. Novosad
*Assistant Examiner*—Joseph Falk
*Attorney, Agent, or Firm*—Ernest Peter Johnson

[57] ABSTRACT

The drive assembly is used in connection with a well assembly. The well assembly comprises a tubing string having a rod string positioned therein. In accordance with the invention, a box frame is connected to the upper end of the tubing. A rotatable spindle or rotor is mounted on the frame above the upper end of the tubing. The rotor defines an axial bore. The polish rod of the rod string extends through the rotor bore. A polish rod clamp seats in a key seat in the rotor and grips the polish rod. The clamp functions to drivably interconnect the rotor and rod string and to suspend the rod string from the rotor and thus the wellhead. Means are provided to rotate the rotor. A stuffing box is mounted on the tubing end within the confines of the frame, to provide a seal around the rod string.

4 Claims, 3 Drawing Figures

ROTARY DRIVE ASSEMBLY FOR DOWNHOLE ROTARY PUMP

FIELD OF THE INVENTION

This invention relates to a rotary drive assembly for suspending and rotating a well string, such as a rod string.

BACKGROUND OF THE INVENTION

Many conventional oil wells include a rod string, which is reciprocated at surface by a pump jack to actuate a downhole pump.

Recently, rotary drive downhole pumps have been developed; these pumps find particular application in the production of crude oil laden with sand. A pump of this type is driven by a rotating drive string (such as a rod string or a tubular string), which is suspended in a stationary tubular production string.

There is a need for a rotary drive assembly which satisfactorily suspends the drive string and rotates it.

Such an assembly should be capable of permitting the drive string to be easily adjusted longitudinally, so that more or less drive string is in the wellbore. It should also preferably be adapted to permit of the use of an effective, conventional device, such as a stuffing box, to provide a seal around the drive string at the point where it protrudes from the upper end of the well's production string.

SUMMARY OF THE INVENTION

In accordance with the invention, there is provided a frame, such as a box frame, which is connected with the production string or the wellhead. A rotor assembly is rotatably mounted on the frame in spaced relation above the upper end of the production string. The rotor assembly has an axial bore therethrough. The drive string includes a polish rod at its upper end. This polish rod extends through the rotor assembly bore. Means, such as a conventional polish rod clamp, drivably interconnects the polish rod and the rotor assembly and suspends the drive string from said rotor assembly.

If the drive string is to be adjusted vertically, this can now be accomplished by gripping the polish rod with a second clamp held by a lifting means, such as a gin pole apparatus, undoing the first polish rod clamp, and raising or lowering the drive string through the rotor assembly, as required. The original polish rod clamp is then re-tightened to reconnect the rotor assembly and drive string, when the latter is in the desired position.

Thus, by clamping a rotatable, driven, hollow rotor assembly, a polish rod extending through the rotor assembly, and suspending clamp which disengageably interlocks the drive string and rotor assembly, easy vertical adjustability of the drive string is made feasible.

By using the frame to space the rotor assembly above the upper end of the production string, it is also now possible to attach a conventional, well-proven stuffing box to the production string to seal around the drive string.

Broadlystated, the invention comprises a rotary drive assembly, for use with a well assembly and a drive string to be suspended and rotated in the production string of the well assembly, comprising: a frame connectable with the well assembly; a spindle rotatably mounted on the frame, said spindle forming an axial bore through which the drive string may extend; said spindle forming means for locking with a clamping means; disengagable means for clamping on to the drive string, said clamping means being adapted to seat on the spindle, whereby the drive string may be suspended from the spindle by the clamping means, said clamping means and locking means being adapted to interconnect the spindle and drive string for rotation together; and means associated with the spindle for rotating the latter to thereby rotate the drive string.

In another broad aspect, the invention comprises in combination: a well assembly comprising a production string; a rod string, including a polish rod at its upper end, positioned in the production string with the polish rod extending out of the upper end of the production string; a frame connected with the well assembly and extending above the upper end of the production string; a spindle rotatably mounted on the frame, said spindle forming an axial bore through which the polish rod extends; said spindle forming means for locking with a clamping means; disengagable means for clamping on to the polish rod, said clamping means being adapted to seat on the spindle, whereby the drive string is suspended from the spindle by the clamping means, said clamping means and locking means being operative to interconnect the spindle and rod string for rotation together; and means associated with the spindle for rotating the latter to thereby rotate the drive string.

DESCRIPTION OF THE PREFERRED EMBODIMENT

Figure 1:
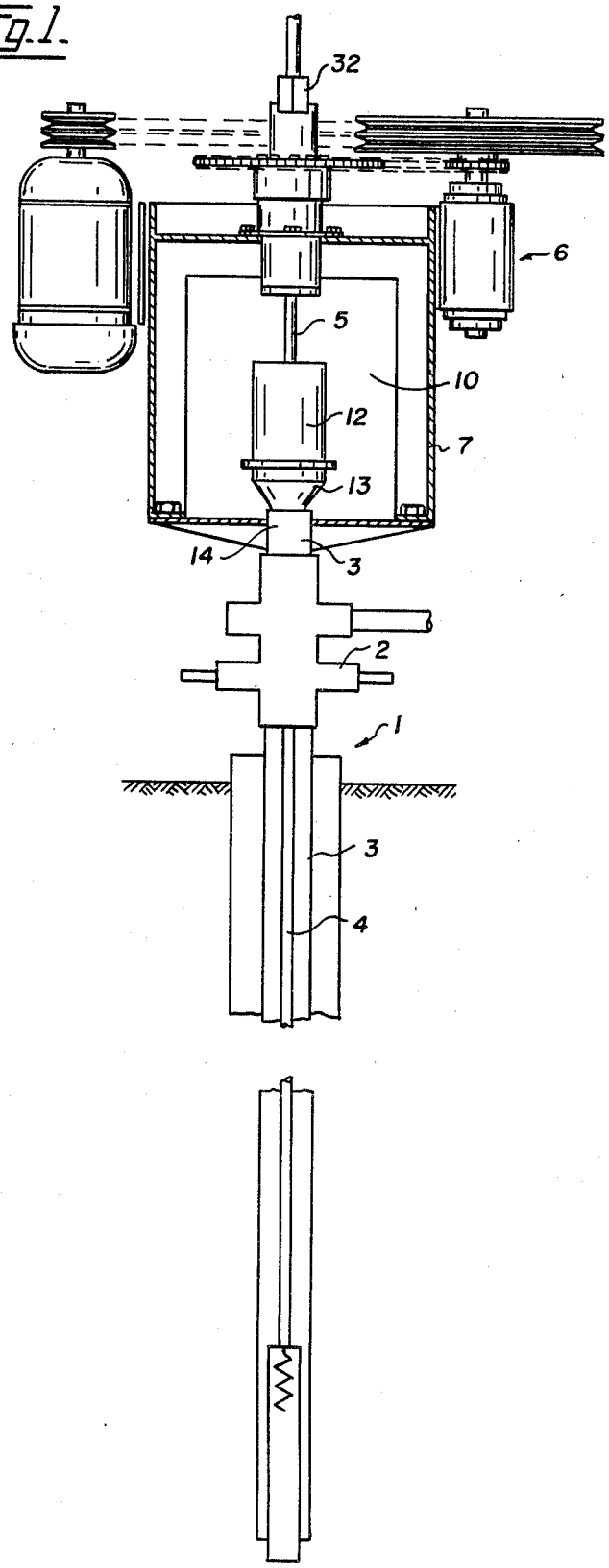
FIG. 1 is a partly schematic, partly sectional side view showing the rotary drive assembly in the context of a well assembly which includes a well head and a tubing production string.

With reference to FIG. 1, there is shown a conventional well assembly 1 comprising a wellhead 2 and the upper end of a tubing production string 3.

A drive string 4, comprising a polish rod 5 at its upper end, is positioned within the production string 3. In the case of a drive string of the solid rod type, the polish rod will usually be solid in nature; in the case of a tubular drive string, the polish rod may be either solid or tubular in nature.

Figure 2:
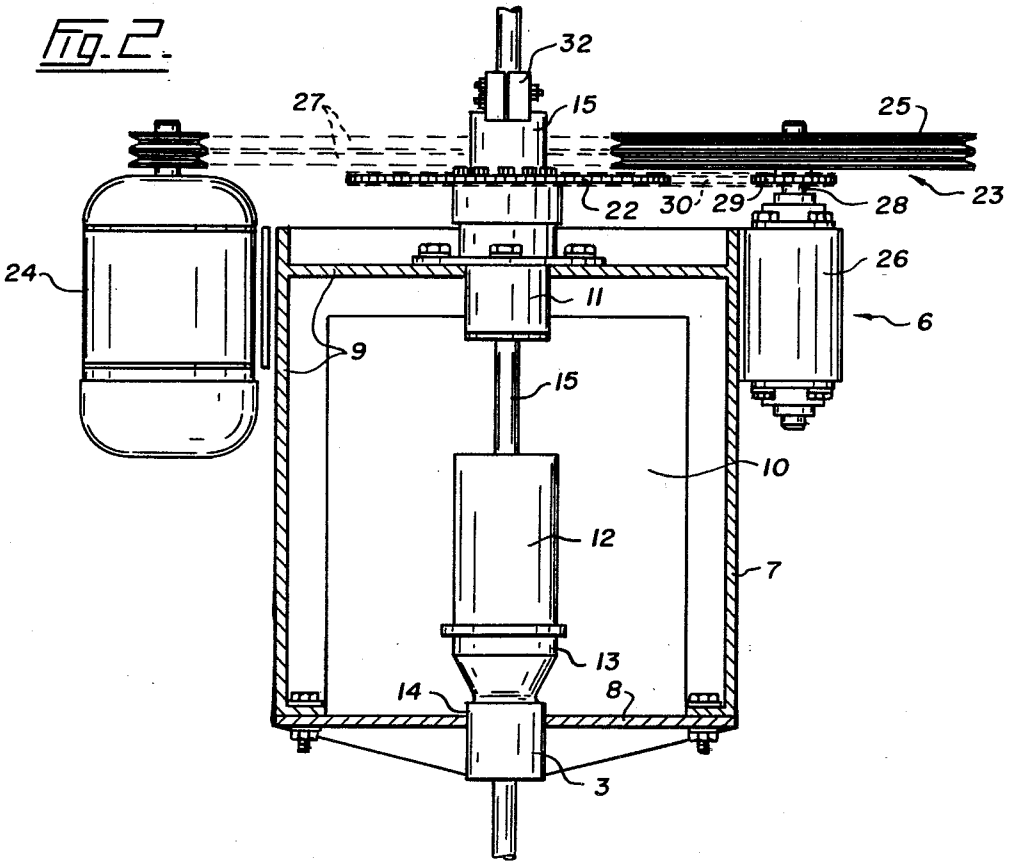
FIG. 2 is a partly sectional side view showing the box frame, stuffing box, rotor assembly and drive means, associated with a tubing production string and a rod drive string.
Figure 3:
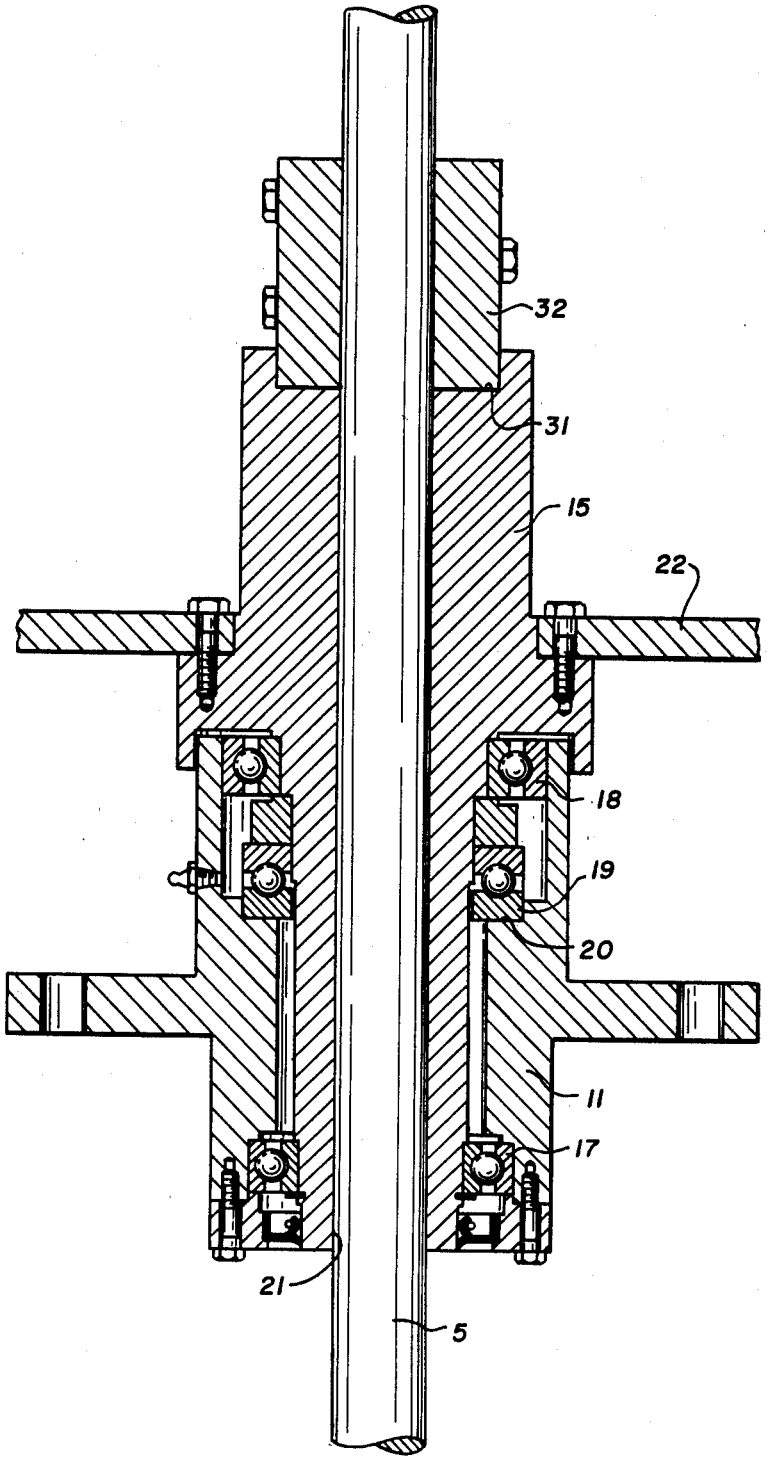
FIG. 3 is a sectional side view of the rotor assembly.

Turning now to FIGS. 2 and 3, the rotary drive assembly 6 comprises a box frame 7. The frame 7 consists of a lower horizontal member 8, attached to the upper end of the production string 3, and an inverted C-shaped member 9 bolted to member 8. The C-shaped member 9 provides an enclosed cavity 10. The C-shaped member 9 further includes a centrally located, cylindrical support member 11 bolted to its upper end, for a purpose to be explained.

A conventional stuffing box 12 is disposed in the cavity 10. The stuffing box 12 is connected by a swage 13 and collar 14, forming a part of the frame member 8, to the top end of the production string 3. The stuffing box 12 seals around the polish rod 5 to prevent the escape of fluid from the production string 3.

The rotary drive assembly 6 further includes a bored spindle 15, which is rotatably mounted in the cylindrical support member 11 by means of a pair of spaced radial bearings 17, 18 and an axial bearing 19. The radial bearings 17, 18 function to centralize the spindle 15 within the support member 11; the axial bearing 19 is positioned on the horizontal shoulder 20 of support member 11 to transmit vertical loads from the spindle 15 to the cylindrical support member 11. As shown, the spindle 15 defines an axial bore 21, through which the polish rod 5 extends. A sprocket 22 is connected with the spindle 15. The sprocket 22 provides a drive connection with the drive means 23, which are now to be described and which form part of the rotary drive assembly 6.

The drive means 23 comprises a motor 24, which drives the sheave 25 of a gear reducer 26 through belts 27. The gear reducer sheave 25 rotates a shaft 28 on which it is fixed and which carries a sprocket 29. The sprocket 29 drives spindle sprocket 22 through a chain 30. Thus the motor 23 is operative to rotate the spindle 15.

A rectangular recess 31 is formed in the upper portion of the spindle 15. A conventional rectangular polish rod clamp 32, which can be tightened onto the polish rod 5, seats in the recess 31 and drivably interconnects the polish rod 5 with the spindle 15. The recess 31 therefore provides means on the spindle for locking with the clamping means to provide a drive interconnection between spindle and string. The clamp 32 also functions to suspend the drive string 3 from the well assembly 1.

The clamp 32 is the last of the components which together make up the rotary drive assembly 6.

In operation, the motor 24 acts to rotate the spindle 15 through the belt and sprocket system. Rotation of the spindle 15 rotates the rod clamp 32, which is locked to it. The rotating rod clamp 32 functions to turn the drive string 3 while holding it suspended.

It is to be understood that the preceding detailed description is only exemplary. The scope of the invention is defined in the accompanying claims.

The embodiments of the invention in which an exclusive property or privilege is claimed are defined as follows:

1. A rotary drive assembly, for use with a well assembly and a drive string to be suspended and rotated in the production string of the well assembly, comprising:

a frame connectable with the well assembly;

a spindle rotatably mounted on the frame, said spindle forming an axial bore through which the drive string may extend;

said spindle forming means for locking with a clamping means;

disengagable means for clamping on to the drive string, said clamping means being adapted to seat on the spindle, whereby the drive string may be suspended from the spindle by the clamping means, said clamping means and locking means being adapted to interconnect the spindle and drive string for rotation together;

and means associated with the spindle for rotating the latter to thereby rotate the drive string.

2. In combination:

a well assembly comprising a production string;

a rod string, including a polish rod at its upper end, positioned in the production string with the polish rod extending out of the upper end of the production string;

a frame connected with the well assembly and extending above the upper end of the production string;

a spindle rotatably mounted on the frame, said spindle forming an axial bore through which the polish rod extends;

said spindle forming means for locking with a clamping means;

disengagable means for clamping on to the polish rod, said clamping means being adapted to seat on the spindle, whereby the drive string is suspended from the spindle by the clamping means, said clamping means and locking means being operative to interconnect the spindle and rod string for rotation together;

and means associated with the spindle for rotating the latter to thereby rotate the drive string.

3. The combination as set forth in claim 2 comprising:

means, mounted on the upper end of the production string and disposed within the frame, for sealing around the polish rod to prevent fluid from escaping from said production string.

4. The combination as set forth in claim 3 wherein: the sealing means is a stuffing box.

* * * * *